US005732320A

United States Patent [19]

Domagall et al.

[11] Patent Number: 5,732,320

[45] Date of Patent: Mar. 24, 1998

[54] CLEANING BLADE

[75] Inventors: Kathryn A. Domagall, Webster; Francois Soos, Rochester; Nero R. Lindblad, Ontario; Edward L. Schlueter, Jr., Rochester; Robert N. Finsterwalder, Webster, all of N.Y.

[73] Assignee: Xerox Corporation, Stamford, Conn.

[21] Appl. No.: 720,644

[22] Filed: Oct. 2, 1996

[51] Int. Cl.[6] ..... G03G 21/00

[52] U.S. Cl. ..... 399/350; 399/351

[58] Field of Search ..... 399/350, 351; 15/256.51, 256.52

[56] References Cited

U.S. PATENT DOCUMENTS 4,989,047 1/1991 Jugle et al. .

5,031,000 7/1991 Pozniakas et al. .

5,339,149 8/1994 Lindblad et al. .

5,349,428 9/1994 Derrick .

5,416,572 5/1995 Kolb et al. .

*Primary Examiner*—Matthew S. Smith

*Attorney, Agent, or Firm*—Annette L. Bade

[57] ABSTRACT

A spots cleaning blade for use in a cleaning apparatus in an imaging apparatus for cleaning agglomerate particles from an imaging surface, the spots cleaning blade comprising a polyether urethane and having a high hardness and low coefficient of friction.

22 Claims, 4 Drawing Sheets

CLEANING BLADE

BACKGROUND OF THE INVENTION

The present invention relates to a blade material useful in an electrophotographic printing apparatus, and specifically a blade material useful in a cleaning blade, in particular a spots blade, used therein to remove particles, especially agglomerated particles, adhering to the charge-retentive, image bearing or photoconductive member.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto. This process is well known and useful for light lens copying from an original and printing applications from electronically generated or stored originals, and in ionography.

In a reproduction process of the type as described above, it is inevitable that some residual toner will remain on the photoconductive surface after the toner image has been transferred to the sheet of support material (e.g., paper). It has been found that with such a process, the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. Hereinafter, the term "residual particles" encompasses residual toner and other residual particles remaining after image transfer. The residual particles adhere firmly to the surface and must be removed prior to the next printing cycle to avoid interfering with recording a new latent image thereon.

Various methods and apparatuses may be used for removing residual particles from the photoconductive imaging surface. Hereinbefore, a cleaning brush, a cleaning web, and a cleaning blade have been used. Both cleaning brushes and cleaning webs operate by wiping the surface so as to affect transfer of the residual particles from the imaging surface.

However, a different type of cleaning device is needed for removal of agglomerates of toner and/or debris. Specifically, toner particles agglomerate with themselves and with certain types of debris such as paper fibers, dirt and the like, thereby forming spot-wise depositions that eventually strongly adhere to the charge retentive surface. These spots range from 50 micrometers to greater than 400 micrometers in diameter and 5 to 25 micrometers in thickness, but typically are about 200 to about 250 micrometers in diameter and 5 to 15 micrometers in thickness. The agglomerates range in material compositions from toner by itself to a broad assortment of plastics and debris from paper. The spots may appear at random positions on the surface of the photoreceptor. Because the spot material is charged when passing under the charge corotron, the toner is subsequently developed on it. When the image is developed and subsequently transferred to a copy substrate, the toner on the spot is also transferred to the copy substrate. Accordingly, the spots cause a copy quality defect showing up as a black spot on a background area of the copy which is the same size as the spot on the photoreceptor. The spot on the copy varies slightly with the exact machine and the specific operating conditions, but cannot be deleted by controlling the machine process controls.

Attempts to eliminate the agglomerate spotting by controlling of extraneous debris or by preventing the formation of agglomerates have been found difficult to implement. Additionally, the formation of agglomerates that the toner formed itself cannot be effectively eliminated. It is theorized that the spots are not the result of a continuing nucleation process, but instead, the spots appear instantaneously on the charge retentive surface. Also, newer deposited spots more weakly adhere to the surface than older spots.

Several copier products commonly use a urethane blade material (e.g. 107-5, supplied by Acushnet) as a spots blade. The spots blade is positioned, after or downstream from the cleaning station, to remove agglomerations and debris from the photoreceptor. The purpose of the blade is not for removing toner, but for removing agglomerated spots. Therefore, the set up parameters for the spots blade (for example, the blade load and angles) are different from a standard cleaning blade. Specifically, with the standard cleaning blade, the blade force and angles are set so that the cleaning edge slides on the photoreceptor in a tuck configuration. Alternatively, for the spots blade, the load and angles are set so that the blade does not tuck, but slides on the photoreceptor and "bumps" or "knocks" the spots off the photoreceptor. Preferred spots blades are positioned at a low angle of attack in engagement with the charge retentive surface.

The use of a spots blade as a secondary cleaner for these products has been shown to be effective in removing debris that can cause a spot defect on the copy. However, many of the spots blades presently used have the disadvantage of high friction between the blade and the photoreceptor. This causes the spots blade to intermittently stick to the photoreceptor surface creating a type of bouncing or skipping action of the spots blade as it rides on the photoreceptor. This bouncing or skipping action can cause copy quality defects. Furthermore, spots blades that exhibit high friction can fold over when placed in pressure contact with the photoreceptor. When failure due to fold-over occurs, the blade must be replaced.

These problems are most likely due to the chemical composition of current spots blades. The standard cleaning blades and some of the current spots blades are made from a soft polyester urethane material having a hardness of from about 50 to about 83 Shore A, and on average have a hardness of about 70 Shore A. These soft urethanes have a strong adhesion to the photoreceptor surface. Since the spots blade is located after the cleaner, there is very little toner available for lubrication. This adhesion causes the blade to tuck severely (as explained earlier) and in many cases fold over and fail. Moreover, the high adhesion of these materials to the photoreceptor makes it difficult to start the blade on a clean, new photoreceptor. Blade tucking normally has a low rate of incidence when the photoreceptor surface is dirty (i.e. when the toner density on the photoreceptor surface is high) or when an additive is used. However, a clean photoreceptor surface causes high friction to occur between the blade and the photoreceptor surface making blade start-up on the clean surface difficult. This high friction also causes the blade to bounce intermittently when the machine is making copies. Thus, a low frictional coefficient ($\mu<5$) indicates that the adhesion of urethane to the clean surface is very low. With a low frictional coefficient ($\mu<5$) or even lower ($\mu<3$), the blade will not tuck or foldover at start-up or bounce (chatter) in the running mode. The above problems have a serious impact on blade reliability. However, these problems can be overcome or significantly minimized with the present invention.

U.S. Pat. No. 5,339,149, the disclosure of which is hereby incorporated by reference in its entirety, discloses a spots blade made of a polyester urethane having a low coefficient of friction, low resilience and a hardness of from about 80 Shore A to about 90 Shore A.

U.S. Pat. No. 5,416,572, the disclosure of which is hereby incorporated by reference in its entirety, discloses a spots blade made of a polyurethane material having a hardness of 80 Shore A.

U.S. Pat. No. 5,349,428, the disclosure of which is hereby incorporated by reference in its entirety, discloses a spots blade positioned at a low angle of attack relative to the photoreceptor to minimize tuck occurrence. The spots blade is made of a polyurethane material having a hardness of 80 Shore A.

U.S. Pat. No. 4,989,047, the disclosure of which is hereby incorporated by reference in its entirety, discloses a polyurethane spots blade material having a hardness of 70 Shore A. A relatively low load is applied to the blade and it is positioned at a low angle of attack relative to the photoreceptor.

U.S. Pat. No. 5,031,000, the disclosure of which is hereby incorporated by reference in its entirety, discloses a polyurethane spots blade material having a hardness of 70 Shore A. The blade is supported in a floating support assembly to prevent tuck-under and damage to the blade.

It is desirable to provide a relatively hard spots cleaning blade comprised of a material having a relatively high hardness and high Modulus. It is also desirable to provide a spots cleaning blade which has a reduced coefficient of friction and a reduced tendency to stick or bump on the image bearing member. Additionally, it is desirable to provide a spots blade having a reduced compression set and increased resilience. It is further desirable to provide a spots cleaning blade which is less susceptible to tucking and folding over. Such an improved spots blade would be more efficient in removing toner agglomerates and would provide an increased wear life.

BRIEF DESCRIPTION OF THE FIGURES

Other features of the present invention will become apparent from the following description and upon reference to the drawings, in which.

SUMMARY OF THE INVENTION

Figure 1:
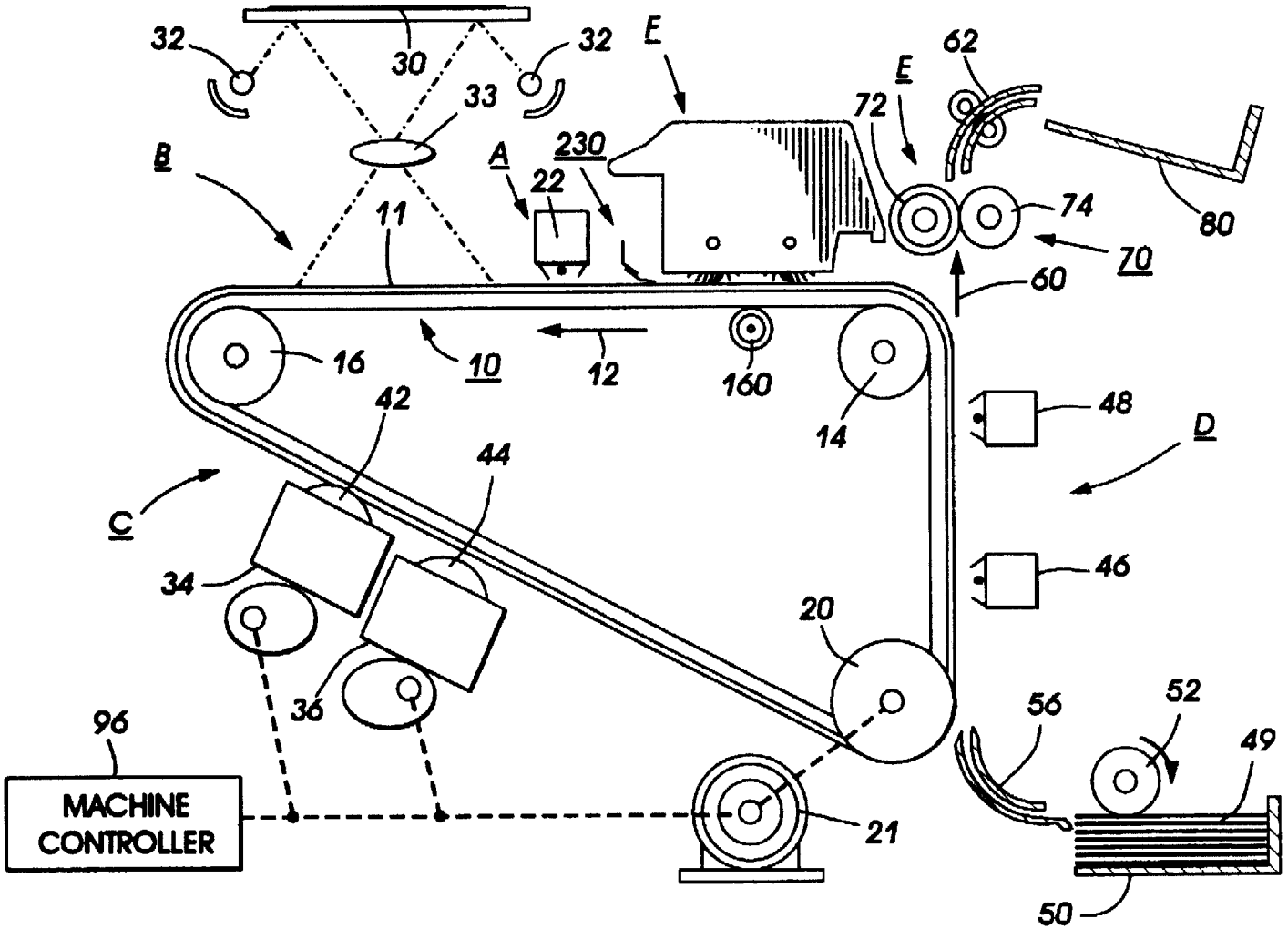
FIG. 1 is a schematic elevational view of a printing apparatus.

Examples of objects of the present invention include:

It is an object of the present invention to provide spots cleaning blades and methods with many of the advantages indicated herein.

Another object of the present invention is to provide a spots cleaning blade having high hardness.

A further object of the present invention is to provide a spots cleaning blade having low friction.

Yet another object of the present invention is to provide a spots cleaning blade which has low compression set.

Another object of the present invention is to provide a spots cleaning blade having increased tear resistance.

Still another object of the present invention is to provide a spots cleaning blade which has increased wear resistance.

In addition, it is an object of the present invention to provide a spots cleaning blade which has increased nip performance and decreased tucking at the nip.

It is still a further object of the present invention to provide a spots cleaning blade which has increased mechanical stability in response to variations in set-up conditions, temperature, and relative humidity.

Moreover yet another object of the present invention is to provide a spots cleaning blade which has increased wear over time and is highly resistant to failure by fracture or excessive stress.

A further object of the present invention is to provide a spots cleaning blade which improves image quality by reducing copy quality defects.

Further another object of the present invention is to provide a spots cleaning blade with a high Modulus.

These and other objects can be accomplished in embodiments of the present invention which include: a cleaning apparatus for cleaning materials from an imaging surface comprising: a housing; a holder attached to the housing; a primary cleaner optionally at least partially enclosed in the housing; and a spots cleaning blade for cleaning agglomerated materials from the imaging surface, the spots blade being positioned downstream from the primary cleaner, the blade having one end coupled to the holder and a free end opposite thereof, the free end being in pressure contact and in continuous slidable contact with the imaging surface, wherein the spots blade comprises polyether urethane.

Embodiments further include: a spots cleaning blade comprising polyether urethane obtained from the reaction product of a) a prepolymer selected from the group consisting of 2,4' diphenylmethane diisocyanate based polytetramethylene glycol and 2,4' toluene diisocyanate based polypropylene glycol, and b) a crosslinking agent, the blade having a hardness of from about 86 to about 100 Shore A and a coefficient of friction of less than about 5.

These and other objects of the present invention can be accomplished in embodiments which include: a spots cleaning blade comprising polyether urethane and having a high hardness of from about 86 to about 100 Shore A.

In embodiments, the present invention is further directed to: an image forming apparatus for forming images on a recording medium comprising: a) a charge-retentive surface to receive an electrostatic latent image thereon; b) a development component to apply toner to the charge-retentive surface to develop the electrostatic latent image to form a developed image on the charge retentive surface; c) a transfer component to transfer the developed image from the charge-retentive surface to a copy substrate; and d) a cleaning apparatus for cleaning materials from the charge-retentive surface comprising: i) a housing; ii) a holder attached to the housing; iii) a primary cleaner at least partially enclosed in the housing; and vi) a spots cleaning blade for cleaning agglomerated material from the charge-retentive surface, the spots blade being positioned downstream from the primary cleaner, the spots blade having one end coupled to the holder and a free end opposite thereof, the free end being in pressure contact and in continuous slidable contact with the charge-retentive surface, wherein the spots blade comprises polyether urethane.

In embodiments, the present invention is further directed to: an electrophotographic process comprising: a) forming an electrostatic latent image on a charge-retentive surface; b) applying toner to the latent image to form a developed image on the charge-retentive surface; c) transferring the toner image from the charge-retentive surface to a copy substrate; and d) cleaning materials from the charge-retentive surface by use of a cleaning apparatus comprising: i) a housing; ii) a holder attached to the housing; iii) a primary cleaner at least partially enclosed in the housing; and vi) a spots cleaning blade for cleaning agglomerated material from the charge-retentive surface, the spots blade being positioned downstream from the primary cleaner, the spots blade having one end coupled to the holder and a free end opposite thereof, the free end being in pressure contact and in continuous slidable contact with the charge-retentive surface, wherein the spots blade comprises polyether urethane.

The spots cleaning blade of the present invention, in embodiments, possesses the improved qualities of increased hardness, low coefficient of friction, high resiliency and low compression set. These properties allow the spots blade to provide exceptional cleaning of agglomerate particles thereby decreasing the possibility of copy quality defects, and to have increased wear life.

DETAILED DESCRIPTION OF THE INVENTION

For a general understanding of an electrophotographic printer or copier in which the present invention may be incorporated, reference is made to FIG. 1 which depicts schematically various components thereof in an embodiment of the present invention. Although the spots blade of the present invention is equally suitable for use in a printer or copier, it should become evident from the following discussion that the spots cleaning blade disclosed herein is equally well suited for use in other applications and is not necessarily limited to the particular embodiments shown herein.

A reproducing machine, in which the present invention may be used, has a photoreceptor belt 10, having a photoconductive, charge-retentive or imaging surface 11. The photoreceptor belt moves in the direction of arrow 12 to advance to various stations.

The belt passes through charging station A where it receives a substantially uniform potential charge from corona device 22. At exposure station B, an original document is positioned face down on transparent platen 30 for illumination with flash lamps 32. Light rays reflected from the original document are reflected through a lens 33 and projected onto the charged portion of the photoreceptor belt 10. This process records an electrostatic latent image which corresponds to the informational area contained within the original document. At development station C, one of at least two development housings 34 and 36 is brought into contact with the belt 10 for developing the latent image. The electrostatic latent image attracts the toner particles from the carrier beads, thereby forming toner powder images on the photoreceptor belt 10. If two colors of developer material are not required, the second developer housing may be omitted. If more colors are desired, additional development housings may be included.

The photoreceptor belt 10 then advances the developed latent image to transfer station D where a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from belt 10.

After transfer, the sheet moves to fusing station E wherein the developed image is fused to the copy sheet.

Residual particles remaining on the photoreceptor belt 10 after each copy is made may be removed at cleaning station F or stored for disposal. The spots blade apparatus 230 is located downstream in the direction of movement of the photoreceptor from the cleaning station F.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein.

Figure 2:
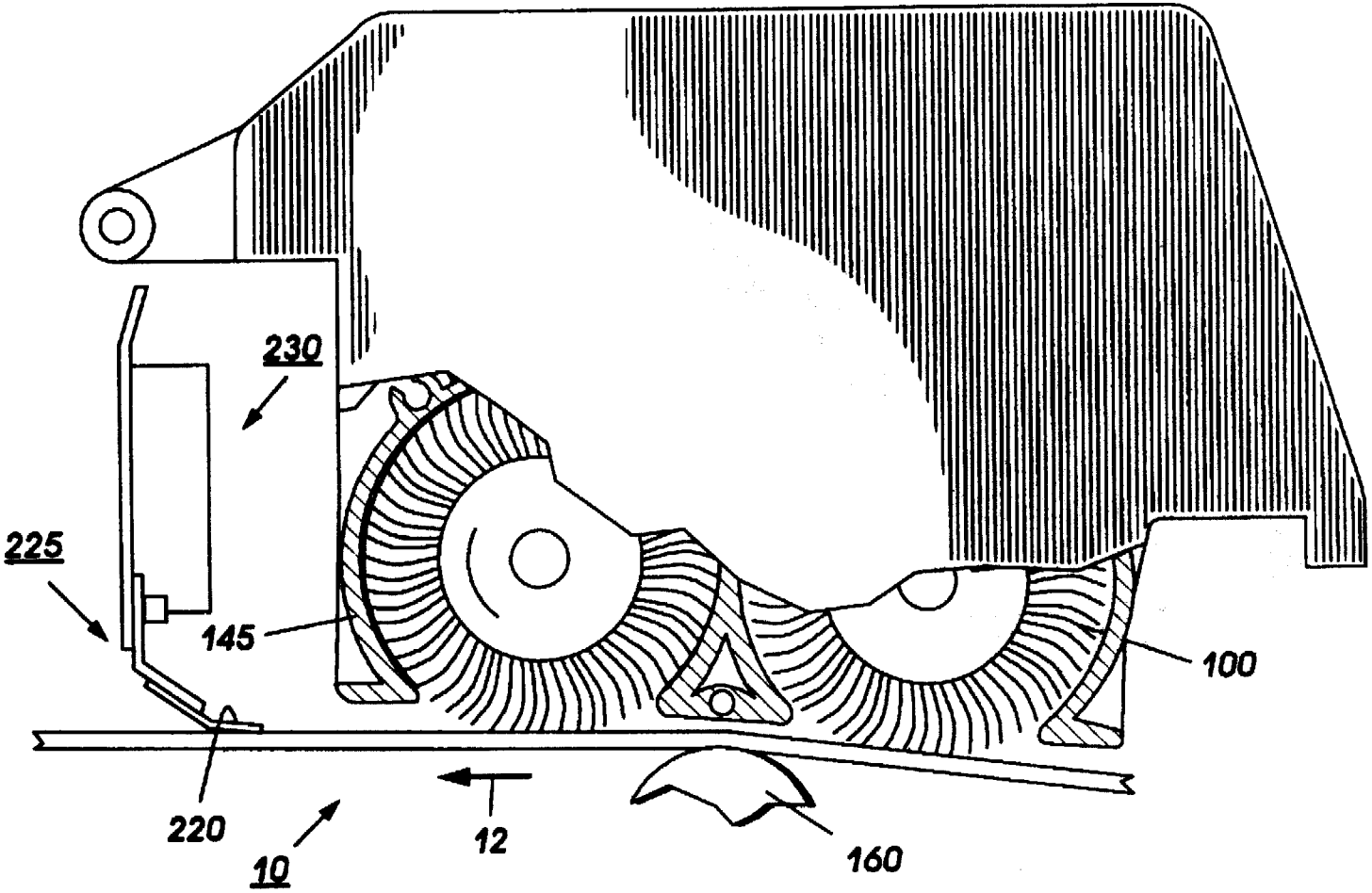
FIG. 2 is a schematic view of a spots blade located downstream from the primary cleaner.

Reference is now made to FIG. 2, which shows an embodiment of the present invention which is a frontal elevational view of the cleaning system and the spots blade assembly 230. The spots blade assembly 230 comprises a holder 225 and a spots disturber blade 220. The spots blade assembly 230 is located downstream, in the direction of movement 12 of the photoreceptor belt 10, to disturb residual particles not removed by the primary cleaner brushes 100. This spots disturber blade 220 is similar to that used in the Xerox 5090 copier. The spots blade disturber 220 is normally in the doctoring mode to allow a build up of residual particles in front of the spots blade 220 (i.e. between the brush cleaner housing 145 and the spots blade 220). This build up of residual particles is removed by the air flow of the vacuum. The spots blade of the present invention combines the mechanical properties of low friction, high resilience, high hardness and low compression set to provide continuous slidable contact between the spots blade 220 and the photoreceptor surface. This continuous slidable contact is a result of the mechanical properties and not a lubricant introduced to the cleaning operation.

The present invention reveals the combination of mechanical properties that are ideal for a spots blade, and a material that supplies these mechanical properties. The ideal mechanical properties of a spots blade are low friction (adhesion), high resiliency, high hardness, and low compression set. Embodiments allow for superior properties in terms of excellent nip performance and increased stability to changes in set up conditions, temperature and relative humidity.

Urethanes are typically formed by the reaction of a polyisocyanate and a compound containing hydroxyl groups according to the general reaction: $R_aNCO+R_bOH$ $R_aNHCOOR_b$, wherein $R_b$ is an ester for the formation of a polyester urethane and an ether for the formation of a polyether urethane. In the present invention, a soft polyester urethane is not used as the spots blade material. Instead, a relatively hard polyether urethane is used as the spots blade material. The polyether urethane is generated by the general reaction of a polyester polyol with a polyisocyanate. A curing or crosslinking agent is usually added. In addition, a catalyst may be added to speed up the reaction and crosslinking.

Examples of suitable polyisocyanates include the diisocyanates selected from the group consisting of diphenylmethane diisocyanates or methylene diisocyanate (MDI), toluene diisocyanates (TDI), naphthalene diisocyanates (NDI), meta and para tetramethylenezylene diisocyanate (TMXDI), isophorone diisocyanate (IPDI), and blends thereof. The diisocyanates are used in an amount of from about 3 to about 12 percent by weight and preferred is from about 10 to about 12 percent by weight of total solids. Total solids as used herein refers to the total percentage by weight of diisocyanate, polyol, crosslinking agent and optional catalyst. Specific diisocyanates useful in the practice of the present invention include 4,4'diphenylmethane diisocyanate, 2,4'diphenylmethane diisocyanate, 2,2'diphenylmethane diisocyanate, 2,4-toluene diisocyanate, 2,6-toluene diisocyanate, naphthalene 1,5-diisocyanate, 2,4-toluenediisocyanate, 1,5-naphthalenediisocyanate, hexamethylene diisocyanate, HDI hydride, an polyfunctional modified polyisocyanate, as well as their isomers, and mixtures thereof.

Examples of suitable polyols include polypropylene-based polyetherpolyol, polyethylene-based polyetherpolyol, polytetramethylene-based polyetherpolyol, copolymerized polyether-based polyol, and mixtures of these polyol components. Examples of preferred polyols include polytetramethylene glycol and polypropylene glycol.

It is preferred to react the polyol and the polyisocyanate to form a prepolymer before reacting with a crosslinking agent. Preferred prepolymers include those commercially available from Uniroyal of Middlebury, Conn. Specifically, preferred prepolymers include an MDI based polytetramethylene glycol which has a molecular weight of about 1000 and an NCO content of from about 10.9 to about 11.5, preferably about 11.3 and is available under the tradename Uniroyal Vibrathane B670 from Uniroyal; a TDI based polypropylene glycol B690 which has a molecular weight of about 1000 and an NCO content of from about 3.85 to about 4.15 and is available from Uniroyal; and an MDI based polytetramethylene glycol B960 which has a molecular weight of about 880 and an NCO content of about 9.5 and is available from Uniroyal. The functional NCO groups of the prepolymer provide a relatively hard and rigid segment in the final polymer chain and act very much like a filler to provide a tough but flexible structure that has both hard and soft domains. The NCO content as used herein is defined as the isocyanate content which is a measurement of the reactive groups left on the prepolymer to form a polymer or crosslinked network. It is preferred that the NCO content be from about 4 to about 15, preferably from about 7 to about 12, and particularly preferred from about 10 to about 11. When a prepolymer is used instead of mixing a diisocyanate with a polyol, the prepolymer is added in an amount of from about 70 to about 99.9 percent by weight, preferably from about 80 to about 90 percent by weight of total solids.

Chain extenders in embodiments of the present invention, such as bifunctional or trifunctional extenders which act as crosslinking agents, are used herein. Typically, suitable bifunctional crosslinking agents are of the formula $OH(R_1)OH$ where $R_1$ is a straight or branched chain alkyl group having from about 2 to about 12 carbon atoms, such as methyl, ethyl, butyl, tert-butyl, and the like. Suitable trifunctional crosslinking agents are generally of the formula $R'—C—[—(OH)_a(CH_2OH)_b]$ where R' is H, $CH_3$ or $C_2H_5$, a is a number 0 or 1, b is a number 2 or 3 and a+b=3. Typical bifunctional chain extenders include ethylene glycol, 1,4 butanediol (BDO), 1,3 butanediol, 1,6 hexanediol; and neopentyl glycol, because these crosslinking agents extend the polymer chain linearly yielding tough wear resistant materials. Examples of trifunctional and higher functional chain extenders include hydroquinonediethylolether, bisphenol A, glycerol, trimethylolpropane (TMP), and trimethylolethane primarily because they crosslink the polymer chains at 90° and yield very set resistant networks. Preferred chain extenders include 1,4 butanediol; 1,6 hexanediol; 1,3 butanediol; trimethylolpropane; trimethylolethane; and commercially available chain extenders which contain a mixture of diol(s) and triol(s) such as, for example, the commercially available extender A-931 available from Uniroyal which is a diol, triol and amine blend to increase chain crosslinking. The bifunctional butanediol acts to extend the chain in a linear way to provide linear soft sites thereby providing the greatest toughness in the final elastomer. Trifunctional trimethylolpropane provides a superior compression set performance primarily because it is trifunctional and provides crosslinking exchange sites to tighten up the network, thereby providing a crosslinked three-dimensional network. In a preferred embodiment of the present invention, the bifunctional butanediol is used in combination with the trifunctional trimethylolpropane to provide soft urethanes with high tear strength, or A-931 is used alone or in combination with a bifunctional and/or trifunctional crosslinking agent. The total amount of combined crosslinking agents is from about 5 to about 20 percent by weight, preferably from about 8 to about 18 percent by weight, and particularly preferred of about 14 weight percent based on the weight of total solids.

An optional catalyst in embodiments of the present invention may be used to speed up the rate of reaction of the crosslinking and extending mechanisms to provide the cured polyether urethane elastomers. Typical conventional catalysts performing this function include tin derivatives such as dibutyltindilaurate and stannous octoate; mercury derivatives such as phenylmercuric acetate and tertiary amines such as Polycat 33, Polycat 41, Polycat 70 and Polycat 77, which are used in conventional amounts, typically from about 0 to about 20 percent by weight, preferably from about 5 to about 10 percent by weight of total solids.

The polyether urethane elastomer of the spots blade of the present invention may be made according to any suitable procedure. For example, all the reactive ingredients including the catalyst may be added at one time or serially to a single reactor vessel to produce the polyether urethane elastomer. However, the resulting reaction is not very controlled in that there are two reactions taking place simultaneously. Thus, formation of a prepolymer, chain extension and crosslinking all occur at the same time. Accordingly, in the process for preparing the polyether urethane of the present invention, it is preferred that the diisocyanate is first reacted with the polyol and then extended with the chain extender. More specifically, it is preferred to prepare a prepolymer of at least a portion of the isocyanate with at least a portion of the polyether polyol to enable the reaction of the NCO groups of the isocyanate with the functional groups of the polyether polyol to form a long chain so that the NCO groups cannot subsequently take up water and retain it in the final polyether urethane elastomer. It is preferred to use an excess of isocyanate and that the isocyanate and polyol not be added in a one to one ratio. Also, it is preferred that there be an excess of NCO in the prepolymer in order for the crosslinker to adequately prepare the polymer. The prepolymer method provides an initial low molecular weight polymeric urethane and provides better control over the polyether urethane formation reaction and eliminates the formation of monomeric urethane. Other advantages in using the prepolymer include ease of manufacture, longer shelf life, safety and more consistent properties in the final polyether urethane.

Once the prepolymer, which is typically a viscous liquid, has been formed, the mixture of crosslinking agents may be added together with the catalyst to form the polyether urethane elastomer. Alternatively, the reaction may be suspended initiated by freezing the reactants at a temperature of the order at −40° F. and the reaction completed at a later date by placing the frozen reactants, for example, in an appropriately heated tool to make a part. Subsequently, after the polymerization reaction has been initiated, the formed polyether urethane may be shaped according to any of the conventional techniques including injection molding, spin casting, flow coating, and the like.

Resiliency, the percent rebound, can be measured according to ASTM D2632 and varies less than 5% and hardness varies less than 10%. The resiliency of the blade of the present invention is preferably relatively high and is from about 10 to about 40, preferably from about 15 to about 35. The resiliency of the blade is a measure of the tear resistance of the blade. The wear life of the spots blade will increase as the resiliency of the blade increases, thereby reducing the possibility of tears and ultimately, replacement of the blade.

The hardness of the blade material of the present invention is greater than known blade materials which are usually 70 Shore A. The blade material herein, in embodiments, has a significantly high and superior hardness of from about 86 to about 100 Shore A, preferably from about 90 to about 98 Shore A, and particularly preferred from about 92 to about 95. The hardness is measured according to ASTM D2240 (5 plies). The hardness is a measure of the stiffness of the blade. It is important that the spots blade have a high hardness in order to provide a blade that knocks or bumps agglomerated toner and/or debris from the imaging surface and to decrease to occurrence of blade tuck and foldover. High Modulus blades are required to function as a spots blade because high shearing forces are needed to remove agglomerated toner. Lower Modulus material will conform to the spot and will not impart sufficient force to remove the toner agglomerate material. A preferred Modulus for the blade materials of the present invention is from about 3,000 to about 25,000 psi, preferably from about 11,000 to about 19,000 psi.

The coefficient of friction is a measure of the static and dynamic forces as materials are sheared against each other and can be measured by a variety of techniques. These forces are a function of material surface energy, normal force, molecular attachment, roughness and surface speed. In Examples I through V, the coefficient of friction was measured according to the Xerox test procedure 88P268(3). This procedure used a metal (preferably stainless steel) cylindrical roll (1 to about 1.5 inch in diameter and 0.5 inch wide) covered with urethane material of the present invention having a thickness of from about 0.05 mm to about 3 mm, preferably 2 mm. The roll was placed on a paper slide (dual purpose white paper of 4 inches by 5 inches, wire side up) lying on a flat, clean surface and the paper is slowly pulled at a velocity of 50 inches per minute from underneath the roll. The normal force of the cylindrical roll was ½ pound. The force to pull the metal roll was measured using a spring gauge or force gauge. The coefficiency of friction measured by this procedure for the urethane materials in accordance with the present invention was determined to be less than 5, preferably less than 3, and particularly preferred from about 0.05 to about 1.

In Example VI, the coefficiency of friction was measured using a different technique which the inventors have termed the urethane adhesion fixture test. In this urethane adhesion fixture test, the coefficient of friction is measured by sliding a substantially "clean" blade (4 mm wide) on a moving substantially clean, polished, smooth glass surface in order to simulate closely the action of the blade on a moving clean photoreceptor surface. The urethane blade is held in place by a clamp so that only the cleaning edge (about 25 microns) is visible through magnification. The urethane blade is moved at a velocity of about 0.5 mm per second. This urethane adhesion fixture test procedure creates the same types of failures such as stress cracks, craters and nicks which are found in failed blades in field products. Preferably the coefficient of friction when measured by the urethane adhesion fixture test is relatively low, and is less than about 7, preferably less than about 5, and particularly preferred less than about 3.

It is important that the coefficient of friction for the spots blade be low so as to allow the blade to slide smoothly over the photoreceptor and to increase the occurrence of the blade striking the spots. A lower coefficient of friction also helps to decrease the occurrence of blade chatter, tucking and foldover. Although the actual measurements of the coefficient of friction may vary slightly depending on the method used for testing, the urethane spots blade material of the present invention consistently demonstrates a low coefficient of friction and falls within the above preferred ranges. Further, methods for testing the coefficient of friction are well known to one of ordinary skill in the art.

The compression set is a measure of how quickly the blade springs back into its original shape. It is the permanent deformation that takes place in a material under sustained compression forces, and is measured according to ASTM D395, Method B(1). This method of measuring describes the experimental conditions, procedures and specimen geometry for testing compression set. The preferred compression set is from about 1% to about 10%, and preferably 5%. It is important that the blade have a low compression set to allow the blade to spring back into shape after coming into contact with agglomerated materials or other material which causes the blade to change its shape.

Another advantage of the polyether urethane spots blade of the present invention is that a polyether urethane is more stable to hydrolysis than is polyester urethane. This is important in that the spots blade of the present invention is less susceptible to degradation due to humidity. When the blade is used in an electrophotographic or electrostatographic process, the polyether urethane blade will have a longer wear life due to its increased stability to changes in the environment.

In general, the spots blade application requires a material that possesses high hardness, high Modulus, low compression set, moderate resiliency and low friction. These blade properties enable the blade to remove the toner agglomerates, increase service life and reliability, and reduce photoreceptor abrasion because of a low coefficient of friction between the blade and the photoreceptor.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Spots cleaning blades were fabricated by spin casting in a caster preheated to 110° C. and adding thereto in a one shot process preheated and degassed materials as follows. The following formula was used to prepare the blade materials of Sample 1: 91.2 weight percent or 205.2 grams prepolymer XB-960, and 8.8 weight percent or 19.8 grams of chain extender BDO. The materials were degassed for approximately 40 minutes. The mixture was then subjected to high sheer mixing for two minutes followed by degassing to 0.5 mm of mercury. The mixture was poured into the preheated spin caster, cured and spun for 2 hours at 110° C. Thereafter, the spin cast sheet was removed, cut and placed on a glass slab at room temperature followed by a post oven cure at 110° C. for 16 hours. This was followed by preconditioning on a glass surface at room temperature for 14 days.

Mechanical properties of Sample 1 were determined as follows.

The mechanical properties of Sample 1 are shown below in Table I. Of particular interest is that Sample 1 demonstrated a high hardness of 94 Shore A, a low coefficient of friction of 0.99 measured using Xerox test procedure 88P268(3) described in the present specification, a low compression set of 5% and high resilience of 26%.

TABLE I

Mechanical Properties of Sample I

| Property | Test Method | Test Results |
|---|---|---|
| Hardness (Shore A) | ASTM D2240 (5 plies) | 94 |
| Initial Tangent Modulus (psi) | Spec. 91-0346 | 11783 (11781–11786) |
| Tensile Strength (psi) | ASTM D412, die C | 3651 (2897–3929) |
| Ultimate Elongation (%) | ASTM D412, die C | 281 (212–353) |
| Toughness (in-lbs/in$^3$) | ASTM D412, die C | 7105 (4567–9545) |
| Tensile Stress (psi) | ASTM D412, die C | |
| at 100% | | 2209 (2172–2240) |
| at 200% | | 3011 (2843–3146) |
| at 300% | | Ultimate Elongation less than 300% |
| Tensile Set at 140% (%) | ASTM D412, die C(4) | 27 |
| Tensile Set at 300% (%) | ASTM D412, die C | Ultimate Elongation less than 300% |
| Tear strength (lbs/in) | ASTM D624, die C | 654 (641–667) |
| Resilience (%) | ASTM D2632(5 plies) | 26 |
| Compression Set (%) | ASTM D395, Method B(1) | 5 |
| Abrasion Resistance (mg loss/1000 cycles) | ASTM D4060(2) | 27 |
| Frictional Coefficient | 88P268(3) | 0.99 |

Example II

Sample 2 was prepared as Sample 1 and according to the procedures outlined in Example 1, except that 84 weight percent or 189 grams of XB 960 was added to 16 weight percent or 36 grams of A 931. The results of the mechanical testing of Sample 2 is set forth below in Table II. Of particular interest is that Sample 2 showed a high hardness of 94 Shore A, a low coefficient of friction of 0.77, a high resilience of 32% and a low compression set of 5%.

TABLE II

Mechanical Properties of Sample 2

| Property | Test Method | Test Results |
|---|---|---|
| Hardness (Shore A) | ASTM D2240 (5 plies) | 94 |
| Initial Tangent Modulus (psi) | Spec. 91-0346 | 19193 (17497–20889) |
| Tensile Strength (psi) | ASTM D412, die C | 5237 (4945–5532) |
| Ultimate Elongation (%) | ASTM D412, die C | 272 (241–284) |
| Toughness (in-lbs/in$^3$) | ASTM D412, die C | 6774 (5386–7685) |
| Tensile Stress (psi) | ASTM D412, die C | |
| at 100% | | 1860 (1753–2064) |
| at 200% | | 2816 (2701–3084) |
| at 300% | | Ultimate Elongation less than 300% |
| Tensile Set at 140% (%) | ASTM D412, die C(4) | 23 |
| Tensile Set at 300% | ASTM D412, die C | Ultimate Elongation less than 300% |
| Tear strength (lbs/in) | ASTM D624, die C | 629 (624–636) |
| Resilience (%) | ASTM D2632 (5 plies) | 32 |
| Compression Set (%) | ASTM D395, Method B(1) | 5 |
| Abrasion Resistance (mg loss/1000 cycles) | ASTM D4060(2) | 101 |
| Frictional Coefficient | 88P268(3) | 0.77 |

Example 3

Sample 3 was prepared in accordance with the procedures listed in Example 1, except that 89.9 weight percent or 193 grams of B-670 was added to 10.0 weight percent or 21.8 grams of BDO. The results of the mechanical testing of Sample 3 is set forth below in Table III. Of particular interest is that Sample 3 showed a high hardness of 91 Shore A, a low coefficient of friction of 0.94, a low compression set of 5% and high resilience of 34%.

TABLE III

Mechanical Properties of Sample 3

| Property | Test Method | Test Results |
|---|---|---|
| Hardness (Shore A) | ASTM D2240 (5 plies) | 91 |
| Initial Tangent Modulus (psi) | Spec. 91-0346 | 13440 (13176–13704) |
| Tensile Strength (psi) | ASTM D412, die C | 5000 (4066–5408) |
| Ultimate Elongation (%) | ASTM D412, die C | 287 (230–310) |
| Toughness (in-lbs/in$^3$) | ASTM D412, die C | 8457 (5883–9589) |
| Tensile Stress (psi) | ASTM D412, die C | |
| at 100% | | 2399(2373–2413) |
| at 200% | | 3575 (3522–3628) |
| at 300% | | Ultimate Elongation less than 300% |
| Tensile Set at 140% (%) | ASTM D412, die C(4) | 27 |
| Tensile Set at 300% (%) | ASTM D412, die C | Ultimate Elongation less than 300% |
| Tear strength (lbs/in) | ASTM D624, die C | 520 (505–535) |
| Resilience (%) | ASTM D2632 (5 plies) | 34 |
| Compression Set (%) | ASTM D395, Method B(1) | 5 |
| Abrasion Resistance (mg loss/1000 cycles) | ASTM D4060(2) | 71 |
| Frictional Coefficient | 88P268(3) | 0.94 |

Example 4

Sample 4 was prepared in accordance with the procedures listed in Example 1, except that 80.0 weight percent or 176 grams of B-670 was added to 18.1 weight percent or 38.8 grams of A-931. The results of the mechanical testing of Sample 4 is set forth below in Table IV. Of particular interest is that Sample 4 showed a high hardness of 95 Shore A, a low coefficient of friction of 0.47, a low compression set of 5% and a relatively high resilience of 15%.

TABLE IV

Mechanical Properties of Sample 4

| Property | Test Method | Test Results |
|---|---|---|
| Hardness (Shore A) | ASTM D2240 (5 plies) | 95 |
| Initial Tangent Modulus (psi) | Spec. 91-0346 | 19017 (16887–21147) |
| Tensile Strength (psi) | ASTM D412, die C | 4644 (4321–5191) |
| Ultimate Elongation (%) | ASTM D412, die C | 270 (265–285) |
| Toughness (in-lbs/in$^3$) | ASTM D412, die C | 6605 (6182–7015) |
| Tensile Stress (psi) | ASTM D412, die C | |
| at 100% | | 1902 (1805–1970) |
| at 200% | | 2791 (2703–2885) |
| at 300% | | Ultimate Elongation less than 300% |
| Tensile Set at 140% | ASTM D412, die C(4) | 15 |
| Tensile Set at 300% (%) | ASTM D412, die C | Ultimate Elongation less than 300% |
| Tear strength (lbs/in) | ASTM D624, die C | 497 (482–526) |
| Resilience (%) | ASTM D2632 (5 plies) | 15 |
| Compression Set (%) | ASTM D395, Method B(1) | 5 |
| Abrasion Resistance (mg loss/1000 cycles) | ASTM D4060(2) | 57 |
| Frictional Coefficient | 88P268(3) | 0.47 |

Example 5

Sample 5 was prepared in accordance with the procedures listed in Example 1, except that 85.7 weight percent or 184 grams of B-670, 4.8 weight percent or 10.4 grams of BDO and 9.5 weight percent or 20.3 grams of A-931 were mixed together. The results of the mechanical testing of Sample 5 is set forth below in Table V. Of particular interest is that Sample 5 showed a high hardness of 90 Shore A, a low coefficient of friction of 0.89, a low compression set of 5% and high resilience of 34%.

TABLE V

Mechanical Properties of Sample 5

| Property | Test Method | Test Results |
|---|---|---|
| Hardness (Shore A) | ASTM D2240 (5 plies) | 90 |
| Initial Tangent Modulus (psi) | Spec. 91-0346 | 3415 (3066–3764) |
| Tensile Strength (psi) | ASTM D412, die C | 4711 (4414–5058) |
| Ultimate Elongation (%) | ASTM D412, die C | 251 (246–255) |
| Toughness (in-lbs/in$^3$) | ASTM D412, die C | 5309 (4940–5738) |
| Tensile Stress (psi) | ASTM D412, die C | |
| at 100% | | 1580 (1486–1650) |
| at 200% | | 2959 (2839–3053) |
| at 300% | | Ultimate Elongation less than 300% |
| Tensile Set at 140% (%) | ASTM D412, die C(4) | 6 |
| Tensile Set at 300% (%) | ASTM D412, die C | Ultimate Elongation less than 300% |
| Tear strength (lbs/in) | ASTM D624, die C | 440 (422–457) |
| Resilience (%) | ASTM D2632 (5 plies) | 32 |
| Compression Set (%) | ASTM D395, Method B(1) | 5 |
| Abrasion Resistance (mg loss/1000 cycles) | ASTM D4060(2) | 114 |
| Frictional Coefficient | 88P268(3) | 0.89 |

The above five Tables demonstrate that the "hard" polyether urethanes (greater than about 86 Shore A) have a toughness value in the range of from 5309 to 8457 in-lbs/in$^3$. From previous measurements, the "soft" urethanes (less than about 85 Shore A) have toughness values between 3000 to 5000 in-lbs/in$^3$. Thus, the "hard" polyether urethanes have a toughness value that is approximately 50% greater. A high toughness value is needed in order for the blade to resist tearing of the material when it tucks.

The above tables also show that the polyether urethanes range from 11,000 to 19,000 psi except for Sample 5. The initial tangent Modulus of these "hard" polyether urethanes is about 3 to 10 times greater than for the "soft" urethanes. This is a superior quality and necessary in the spots blade material in order for the blade to resist extension, shear and compression as the blade slides on the clean imaging surface.

All of the "hard" polyether urethanes show a low value for the coefficient of friction ($m<1$) when measured with the Xerox test procedure 99P268(3). Also, the resiliency for these materials ranges from about 15 to about 34. Typically, for urethanes, a resiliency greater than 32 is considered high and a value of less than about 15 is considered low. The resiliency is the ratio of the energy given up when the blade recovers from a tuck to the energy required to produce the tuck. Thus, the resiliency is a measure of the heat energy absorbed by the blade material during the deformation (tucking). Since the spots blade is mainly sliding on a clean surface, a lot of frictional heat can be generated in the material. Therefore, it is desirable to use materials that have a high value for the resiliency to dissipate the heat generated. Such materials include the "hard" polyether urethanes in this invention.

Example 6

Figure 3:
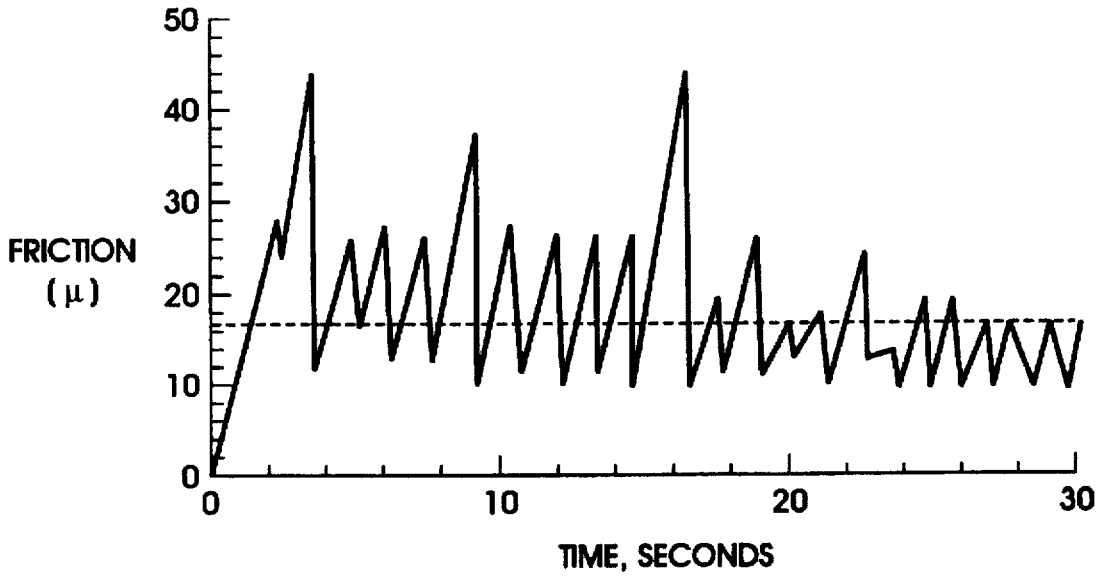
FIG. 3 is a chart of Friction versus Time for a "soft" polyester urethane spots blade having a hardness of 70 Shore A.
Figure 4:
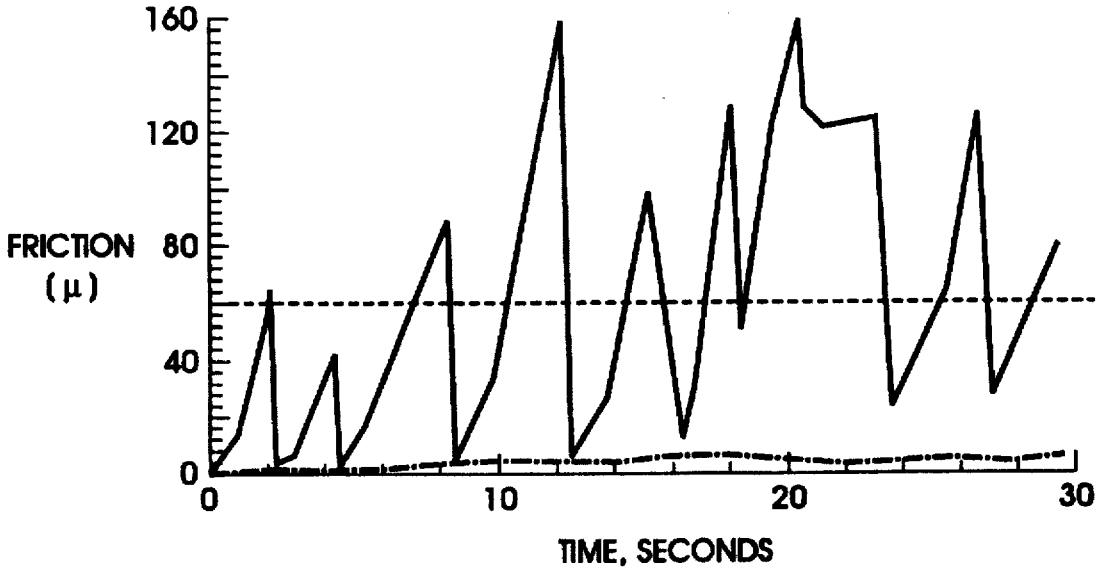
FIG. 4 is a chart showing Friction versus Time for a "soft" polyester urethane spots blade having a hardness of 83 Shore A.
Figure 5:
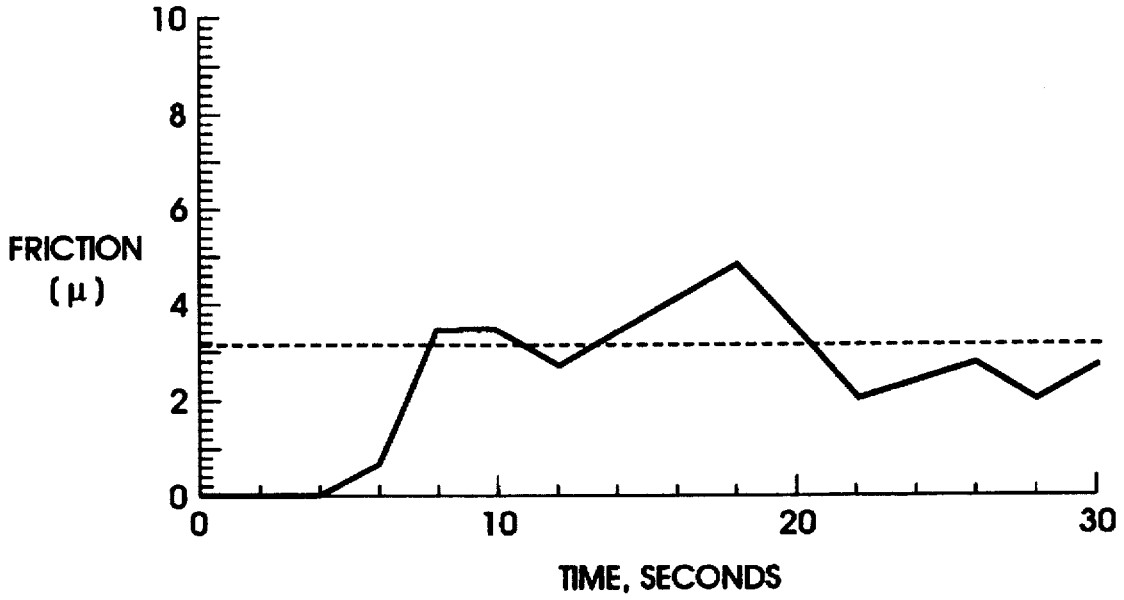
FIG. 5 is a chart showing Friction versus Time for a "hard" polyether urethane spots blade having a hardness of 94 Shore A.

The following study using different durometer urethanes showed that the "softer" materials of less than 83 Shore A exhibited high adhesion to the charge retentive surface when the surface is clean. This high adhesion caused the blade to tuck, chatter and foldover. This is the major failure mode associated with the spots blades that are currently being used. The following experiment was conducted to show the difference in adhesion by comparing a "soft" polyester urethane spots blade to a "hard" polyether urethane spots blade in accordance with the present invention. Three spots blades were tested to demonstrate the difference in adhesion. The result for a "soft" Xerox 5090 polyester urethane spots blade is shown in FIG. 3. The hardness for this spots blade material was 70 Shore A. The result for a "harder" urethane is shown in FIG. 4, wherein a Xerox 4890 polyester urethane spots blade having a hardness of 83 Shore A was tested. The result shown in FIG. 5 is for a "hard" polyether urethane spots blade having a hardness of 94 Shore A. All frictional values were obtained for a clean urethane blade with a normal load of 20 gm/cm sliding on a rotating, clean cylindrical glass surface. As the glass cylinder rotated, the torque was measured. From the measured torque, the coefficient of friction was calculated. All measurements were made at T=72° F. and R=30%.

FIG. 3 demonstrates the strong adhesion of the soft polyester urethane spots blade to the imaging surface. The adhesion is represented by the initial slope or the "stick" portion of the curve. The average coefficient of friction was about 17. Numerous "stick/slip" cycles are shown and several have peaks around $\mu=40$. This was a result of very strong adhesion between the polyester urethane and the surface. The high adhesion immediately created stress fractures and craters near the cleaning edge and ultimately caused the blade to fail.

The results shown in FIG. 4 are for a higher durometer urethane (83 Shore A), and because of the "stick/slip" nature and the strong adhesion of this urethane (high coefficient of friction), it was characterized as a "soft" urethane, that is, urethanes that exhibit high friction. The average coefficient of friction was 60 and several large "stick/slip" cycles between 120 and 160 occurred. Examination of this blade showed stress fractures and craters similar to the 70 Shore A polyester urethane.

Contrary to the above results, the "hard" polyether urethane spots blade in accordance with an embodiment of the present invention exhibited low adhesion to the imaging surface (coefficient of friction about 3.2 on average). In addition, the material did not tuck because of its stiffness. With this hard polyether urethane material, there was no stick/slip motion and the overall performance was much improved over the soft polyester urethane spots blades. The dashed curve in FIG. 5 shows the dramatic difference between the "hard" polyether urethane (94 Shore A) and the "soft" polyester urethane (83 Shore A).

The above examples demonstrate that the polyether urethane spots blade of the present invention, in embodiments, provides the desired mechanical properties of low friction, high resiliency, low compression set and high hardness. These exceptional mechanical properties provide a cleaning spots blade, embodiments of which have a reduced tendency to tuck and fold over which in turn, provide for increased wear life and superior agglomeration cleaning performance.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A cleaning apparatus for cleaning materials from an imaging surface comprising:

a housing;

a holder attached to said housing;

a primary cleaner at least partially enclosed in said housing; and a spots cleaning blade for cleaning agglomerated materials from the imaging surface, the spots blade being positioned downstream from said primary cleaner, said spots blade having one end coupled to said holder and a free end opposite thereof, said free end being in pressure contact and in continuous slidable contact with said imaging surface, wherein said spots blade comprises polyether urethane, wherein said polyether urethane is the reaction product of a prepolymer and a crosslinking agent, and wherein said prepolymer has an isocyanate content of from about 4 to about 15 weight percent.

2. The cleaning apparatus in accordance with claim 1, wherein said prepolymer is the reaction product of a polyol and a diisocyanate.

3. The cleaning apparatus in accordance with claim 2, wherein said diisocyanate is selected from the group consisting of diphenylmethane diisocyanates, toluene diisocyanates, naphthalene diisocyanates, methane diisocyanate, and mixtures thereof.

4. The cleaning apparatus in accordance with claim 3, wherein said diisocyanate is selected from the group consisting of 2,4' diphenylmethane diisocyanate, 2,2' diphenylmethane diisocyanate, 4,4' diphenylmethane diisocyanate, 2,4 toluene diisocyanate and 1,5 naphthalene diisocyanate.

5. The cleaning apparatus of claim 2, wherein said polyol is selected from the group consisting of polypropylene-based polyetherpolyol, polyethylene-based polyetherpolyol, polytetramethylene-based polyetherpolyol, copolymerized polyether-based polyol, and mixtures thereof.

6. The cleaning apparatus in accordance with claim 5, wherein said polyol is selected from the group consisting of polytetramethylene glycol and polypropylene glycol.

7. The cleaning apparatus in accordance with claim 1, wherein said prepolymer is selected from the group consisting of 2,4' diphenylmethane diisocyanate based polytetramethylene glycol and 2,4' toluene diisocyanate based polypropylene glycol.

8. The cleaning apparatus in accordance with claim 1, wherein said isocyanate content is from about 7 to about 12 weight percent.

9. The cleaning apparatus in accordance with claim 8, wherein said isocyanate content is from about 10 to about 11 weight percent.

10. The cleaning apparatus in accordance with claim 1, wherein said spots blade has a hardness of from about 86 to about 100 Shore A.

11. The cleaning apparatus in accordance with claim 10, wherein said hardness is from about 90 to about 98 Shore A.

12. The cleaning apparatus in accordance with claim 11, wherein said hardness is from about 92 to about 95 Shore A.

13. The cleaning apparatus in accordance with claim 1, wherein said spots cleaning blade has a coefficient of friction of less than about 5.

14. The cleaning apparatus in accordance with claim 13, wherein the coefficient of friction is less than about 3.

15. The cleaning apparatus in accordance with claim 1, wherein the crosslinking agent is a bifunctional crosslinking agent selected from the group consisting ethylene glycol, 1,4 butanediol, 1,3 butanediol, 1,6 hexanediol and neopentyl glycol.

16. The cleaning apparatus in accordance with claim 1, wherein said crosslinking agent is a trifunctional crosslinking agent selected from the group consisting of hydroquinonediethylolether, bisphenol A, glycerol, trimethylolpropane, and trimethylolethane.

17. The cleaning apparatus in accordance with claim 1, wherein said blade has a compression set of about 5 percent.

18. The cleaning apparatus in accordance with claim 1, wherein said blade has a resiliency of from about 15 to about 35 percent.

19. A spots cleaning blade comprising a polyether urethane obtained from the reaction product of a) a prepolymer selected from the group consisting of 2,4' diphenylmethane diisocyanate based polytetramethylene glycol and 2,4' toluene diisocyanate based polypropylene glycol, and b) a crosslinking agent, said blade having a hardness of from about 92 to about 95 Shore A and a coefficient of friction of less than about 3.

20. An image forming apparatus for forming images on a recording medium comprising:

a) a charge-retentive surface to receive an electrostatic latent image thereon;

b) a development component to apply toner to said charge-retentive surface to develop said electrostatic latent image to form a developed image on said charge retentive surface;

c) a transfer component to transfer the developed image from said charge retentive surface to a copy substrate; and d) a cleaning apparatus for cleaning materials from said charge-retentive surface comprising: i) a housing; ii) a holder attached to said housing; iii) a primary cleaner at least partially enclosed in said housing; and vi) a spots cleaning blade for cleaning agglomerated material from said charge-retentive surface, said spots blade being positioned downstream from said primary cleaner, said spots blade having one end coupled to said holder and a free end opposite thereof, said free end being in pressure contact and in continuous slidable contact with said charge-retentive surface, wherein said spots blade comprises polyether urethane.

21. An electrophotographic process comprising:

a) forming an electrostatic latent image on charge-retentive surface;

b) applying toner to said latent image to form a developed image on said charge-retentive surface;

c) transferring the toner image from said charge-retentive surface to a copy substrate; and d) cleaning materials from said charge-retentive surface by use of a cleaning apparatus comprising: i) a housing; ii) a holder attached to said housing; iii) a primary cleaner at least partially enclosed in said housing; and iv) a spots cleaning blade for cleaning agglomerated materials from the charge-retentive surface, said spots blade being positioned downstream from said primary cleaner, said spots blade having one end coupled to said holder and a free end opposite thereof, said free end being in pressure contact and in continuous slidable contact with said charge-retentive surface, wherein said spots blade comprises polyether urethane.

22. A spots cleaning blade comprising polyether urethane and having a high hardness of from about 92 to about 95 Shore A.

* * * * *